US009068724B2

(12) United States Patent
Calvin et al.

(10) Patent No.: US 9,068,724 B2
(45) Date of Patent: Jun. 30, 2015

(54) LIGHTING FIXTURE HAVING CLIPPED REVERSE PARABOLIC REFLECTOR

(71) Applicants: Nathan Howard Calvin, Boise, ID (US); Dean Andrew Wilkinson, Boise, ID (US)

(72) Inventors: Nathan Howard Calvin, Boise, ID (US); Dean Andrew Wilkinson, Boise, ID (US)

( * ) Notice: Subject to any disclaimer, the term of this patent is extended or adjusted under 35 U.S.C. 154(b) by 144 days.

(21) Appl. No.: 13/932,001

(22) Filed: Jun. 30, 2013

(65) Prior Publication Data

US 2015/0003074 A1 Jan. 1, 2015

(51) Int. Cl.

| | |
|---|---|
| ***F21V 7/00*** | (2006.01) |
| ***F21V 13/04*** | (2006.01) |
| ***F21S 8/10*** | (2006.01) |

(52) U.S. Cl.

CPC ..... *F21V 13/04* (2013.01); *F21S 48/33* (2013.01); *Y10T 29/49002* (2015.01); *F21S 48/215* (2013.01); *F21S 48/22* (2013.01); *F21S 48/2206* (2013.01); *F21S 48/321* (2013.01); *F21S 48/328* (2013.01); *F21S 48/337* (2013.01)

(58) Field of Classification Search

CPC ..... F21V 13/04; F21V 13/08; F21V 13/045; F21V 13/14

USPC ..... 29/592.1; 362/297, 516, 517, 518, 241, 362/249.02, 240, 268, 298, 299, 300, 301, 362/327, 346

See application file for complete search history.

(56) References Cited

U.S. PATENT DOCUMENTS

| | | | | |
|---|---|---|---|---|
| 4,075,471 | A * | 2/1978 | Jones | 362/300 |
| 4,344,111 | A | 8/1982 | Ruud et al. | |
| 4,623,815 | A * | 11/1986 | Krieg et al. | 313/113 |
| 5,103,381 | A * | 4/1992 | Uke | 362/560 |
| 5,241,457 | A | 8/1993 | Sasajima et al. | |
| 7,198,384 | B2 | 4/2007 | KaKiuchi et al. | |
| 7,604,385 | B2 | 10/2009 | Albou | |
| 8,083,379 | B2 | 12/2011 | Schulz et al. | |
| 8,278,806 | B1 | 10/2012 | Moskowitz | |
| 8,328,392 | B2 | 12/2012 | Hung et al. | |
| D682,458 | S | 5/2013 | Calvin et al. | |
| 2002/0165378 | A1 | 11/2002 | Kato et al. | |
| 2012/0243235 | A1 | 9/2012 | Gao | |
| 2012/0294024 | A1 | 11/2012 | Peck et al. | |

FOREIGN PATENT DOCUMENTS

| | | | | |
|---|---|---|---|---|
| WO | WO2012055091 A1 | 5/2012 | | |
| WO | WO2012055091 A1 * | 5/2012 | | F21S 2/00 |

OTHER PUBLICATIONS

Carclo Optics, Guide to Choosing Secondary Optics, Catalog 2012, pp. 5 & 6; Carclo Technical Plastics, 600 Depot Street Latrobe, PA 15650 USA www.carclo-optics.com.

Carclo Optics, Guide to Choosing Secondary Optics, Catalog 2012, pp. 5 & 6; Carclo Technical Plastics, 600 Depot Street Latrobe, PA 15650 USA www.carclo-optics.com, 724-539-6982.

* cited by examiner

*Primary Examiner* — Andrew Coughlin
*Assistant Examiner* — Glenn Zimmerman
(74) *Attorney, Agent, or Firm* — Gerard Carlson

(57) ABSTRACT

A lighting fixture employs one or more reverse parabolic reflectors and molded lenses in a faceplate to provide a variety of light output intensities and emission patterns. Some embodiments clip the reverse parabolic reflectors to fit within the outline of the faceplate without sacrificing significant light output.

19 Claims, 13 Drawing Sheets

LIGHTING FIXTURE HAVING CLIPPED REVERSE PARABOLIC REFLECTOR

CROSS REFERENCE TO RELATED APPLICATIONS

U.S. patent application Ser. No. 13/844,007 filed on Mar. 15, 2013, entitled "Configurable Lamp Assembly", by Wilkinson and Calvin is incorporated here by reference.

FEDERALLY SPONSORED RESEARCH OR DEVELOPMENT

Not applicable.

JOINT RESEARCH AGREEMENT

Not applicable

SEQUENCE LISTING

Not applicable

FIELD OF THE INVENTION

The present invention relates to the field of lighting fixtures, and in particular to lenses and reflectors for lighting fixtures.

BACKGROUND OF THE INVENTION

To achieve desired patterns of light emissions, lighting fixtures have used lenses and reflectors. Often, the area and volumetric constraints imposed on lighting fixtures preclude traditional arrangements of lenses or reflectors.

SUMMARY OF THE INVENTION

In one embodiment a lighting fixture has a light transmissive faceplate defining a perimeter or outline. One or more lenses are molded or placed into the faceplate. One or more clipped reverse parabolic reflectors referred to by the initials RPR or RPRs in the plural, fit into locations defined in the faceplate. The defined locations in the faceplate constrain the placement and angle of each clipped reverse parabolic reflector. This constraint permits the aiming of each reflector enabling a selected light emission pattern from the faceplate. The reverse parabolic reflectors are clipped in the sense that one or more are trimmed to fit within the perimeter of the faceplate. One or more light emitters, such as LEDs, (light emitting diodes) are centered in each lens and in each reverse parabolic reflector. In embodiments where the LEDs emit light in a substantially lambertian pattern, the lenses and reflectors are adapted to gather and redirect the light in the desired directions.

The molded lenses can be of the totally internal reflection type, or of the reflector type or a mix of the two. Other lens types are also possible. The totally internal reflection type of molded lenses are commonly referred to by the initials "TIR". Molded reflective lenses also have a reflective coating applied to a portion of the lens.

In some embodiments, the clipped RPRs are clipped to increase the number of RPRs within the outline of the faceplate thus increasing the summation or total of the areas of the clipped RPRs within the outline of the faceplate. Clipped RPRs abbreviated as CRPR or CRPRs in the plural, are fixed together in some embodiments to form a cluster. The fixing to form a cluster can be accomplished in a number of ways including, adhesives, solvent welding and mechanical means. The faceplate can further seal against a lamp housing to seal the lenses, reflectors and light emitters from an outside environment. Thus the faceplate simultaneously performs several functions in that it has molded lenses, holds and orients lenses and parabolic reflectors, and seals against an external environment.

In one embodiment, the faceplate can be a single piece of polycarbonate or acrylic. Depending upon the embodiment and application, other material types are also applicable. For example, in critical applications a lens grade polycarbonate can be used while in less critical applications, an acrylic plastic might be suitable.

In other embodiments, the lighting fixture uses a faceplate that has a planar face. The planar faceplate has a closed perimeter. A number of molded lenses are molded into the faceplate within the perimeter of the faceplate. The faceplate further defines one or more locations for one or more CRPRs that fit into the locations for the CRPRs. In still other embodiments, some of the CRPRs are attached together forming a cluster prior to fitting into the defined locations in the faceplate. The CRPRs themselves have a defined planar area and are adapted to emit light along an axis perpendicular to this defined planar area. Within the faceplate each lens and RPR has a light emitter centered in each lens and in each CRPR.

In still other embodiments, the defined location for a CRPRs, aims light emitted from the CRPR at an angle other than perpendicular to the planar face of the faceplate. In yet other embodiments the molded lenses are adapted to emit light at an angle other than perpendicular to the planar face of the faceplate. This enables faceplates that aim the light from the reflectors in various desired directions. As discussed previously, the molded lenses can be of the totally internal reflection type, or of the reflector type or a mix of the two. Other lens types are also possible. Molded reflective lenses also have a reflective coating applied to a portion of the lens.

Building a light fixture, begins with the selection of the faceplate or planar fame, and the perimeter of the planar faceplate. Space constraints of the application may also dictate the perimeter shape and area of the planar faceplate. Space constraints may also dictate the depth of the entire lighting fixture. Further, the amount of light and light pattern can constrain the number of type of reflectors and lenses such as RPRs or CRPRs, TIR or molded reflective lenses. The desired light emission pattern can also determine the angle at which lenses and reflectors are molded into or placed in the faceplate.

To fit more surface area or light emitters into a given area, selectively clipping the edges on a RPR forms a clipped reveres parabolic reflector or CRPR. Clipped reverse parabolic reflectors enable more emitters and, in many cases, more reflector area within the planar faceplate. In other embodiments, CRPRs are fixed together to form a cluster prior to placement within the planar faceplate.

TIR and molded reflective lenses are molded into the planar faceplate along with locations for individual or clusters of RPRs or clusters of CRPRs. In embodiments where reflectors are molded into the planar faceplate, silvering or reflective coatings are added to selected areas.

Light emitters such as LEDs are placed behind or in the lenses and reflectors to illuminate the lighting fixture. Providing a lamp housing and sealing the faceplate or planar faceplate against a lamp housing provides further strength and seals against external contamination.

BRIEF DESCRIPTION OF DRAWINGS

The summary above, and the following detailed description will be better understood in view of the enclosed drawings which depict details of preferred embodiments. Like reference numbers designate like elements. It should however be noted that the invention is not limited to the precise arrangement shown in the drawings. The features, functions and advantages can be achieved independently in various embodiments of the claimed invention or may be combined in yet other embodiments.

FIGS. 5AP-5DP show plan views of various embodiments of a planar frame or faceplate having a combination of molded lenses and CRPRs.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modification to the various disclosed embodiments may be made and other embodiments may be utilized, without departing from the spirit and scope of the present invention. The following detailed description is therefore, not to be taken in a limiting sense.

Figure 1A:
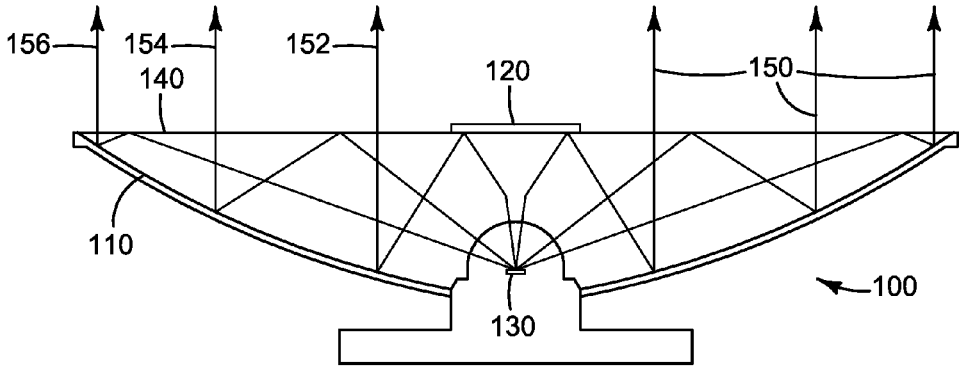
FIGS. 1A-1C show an embodiment of a RPR.

FIG. 1A shows one embodiment of a reverse parabolic reflector 100 hereafter referred to by the initials RPR or RPRs in the plural. The RPR has a parabolic reflector surface 110 and a front mirrored reflective surface 120. A light emitter 130, such as an LED, emits light depicted in FIG. 1A as a number of rays 150, 152, 154, 156. The light rays 150, 152, 154, 156 are emitted from the front surface 140 of the RPR. The RPR surface 140 has a defined area and in many embodiments is planar. The light emitter 130 can be any of a number of light sources such a light emitting diode (LED), incandescent, halogen, fluorescent or others. Many LEDs emit light in a substantially lambertian pattern where the greatest portion of the light is emitted toward the front mirrored reflective surface 120 while the light emission tapers off as the angle increases away from perpendicular to the front surface 140 of the RPR 100. The RPR emits light through the front surface 140 in a number of ways. Ray 152 results from a first reflection off of the front reflective surface 120 and a second reflection off of the parabolic surface 110. Rays 154 and 156 result from an internal reflection off of the front surface 140 followed by reflection off of the parabolic surface 110. In some embodiments the rays decrease in intensity with distance from the center of the RPR. Consequently, ray 152 is more intense than ray 154 which is more intense than ray 156.

This decrease in light ray intensity means that areas of the front surface 140 of the RPR farther from the front mirrored reflective surface 120 contribute less overall illumination on a per area basis. Therefore, areas of the front surface 140 and the corresponding reflector surface 110 may be clipped or trimmed with a less loss of light output compared with areas closer to the front mirrored reflective surface 120 of the RPR 100. Thus it is possible to select a cluster of clipped reverse parabolic reflectors or CRPRs whose summation of defined areas within the perimeter of the faceplate emit more light than non-clipped reverse parabolic reflectors of the same area.

Figure 1B:
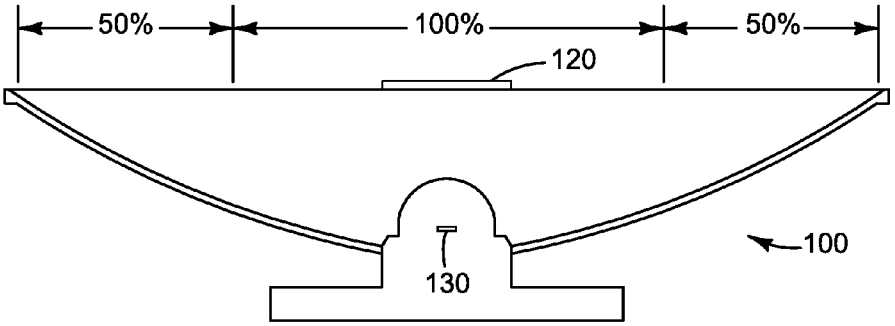
Figure 1C:
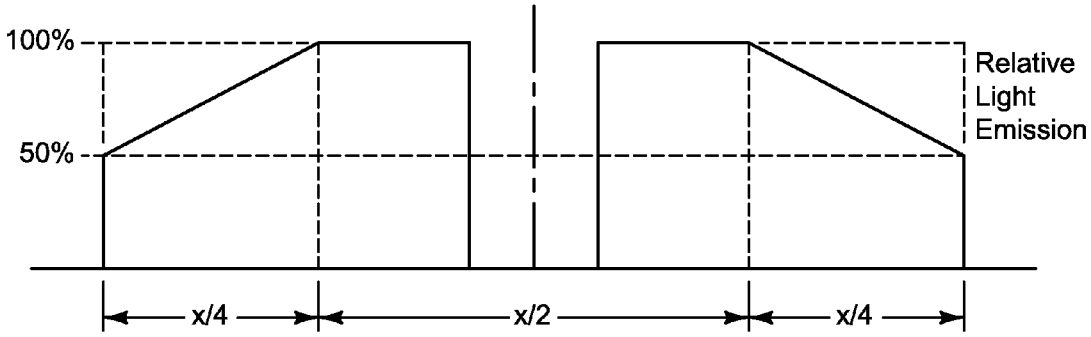

FIGS. 1B and 1C show a simplified view of this decrease in light emission with increasing distance from the center of the RPR 100. In FIG. 1C, the diameter of the RPR shown in profile in FIG. 1B is X. The majority of the light emission is within the area nearest the center of the RPR indicated in FIG. 1C as X/2. This is indicated by a relative light emission of 100%. The areas indicated by X/4, nearest the outer edges of the RPR emit less light as indicted by the lines tapering down from 100% to 50%. It is for this reason that the edges of RPRs can be clipped to form CRPRs without substantial loss of light output from the original RPR.

Figure 2A:
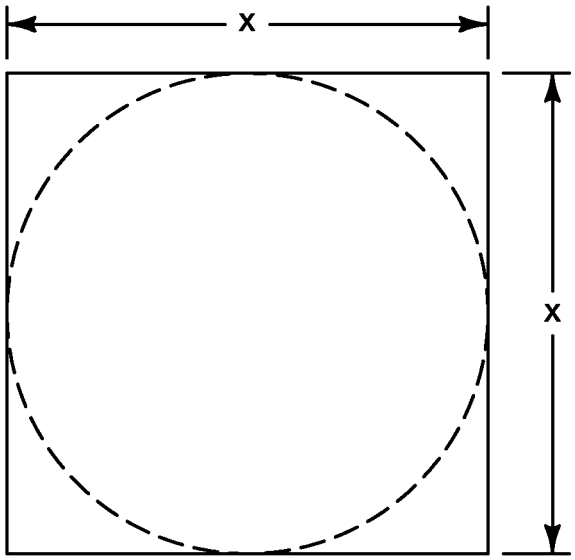
FIGS. 2A-2D show the design and an embodiment of a CRPR.

FIG. 2A shows one embodiment of a square frame with a side equal to X This square represents one possible area and perimeter available for a lighting fixture faceplate. Other shapes are possible for various applications. The typical RPR however is round in shape as indicated by the inscribed circle of FIG. 2A. The area of the square is $X^2$, while the area of the inscribed circle is IF $(X/2)^2$. Thus an area of $X^2-\pi(X/2)^2=X^2/4*(4-\pi)$ or 21% is unused. Additionally, if a single light emitter is allocated for each RPR, only one light emitter could be used in FIG. 2A.

Figure 2B:
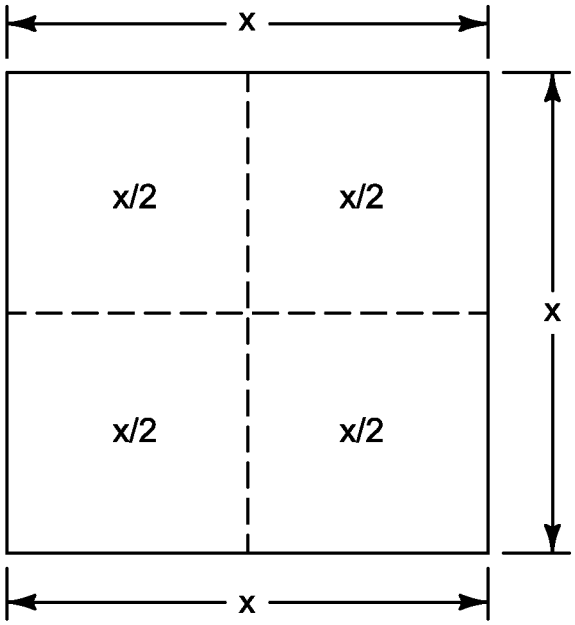

FIG. 2B shows a square with side X divided into four equal sub-squares each with side X/2. This has the advantage of allowed four light emitters. However there is still the issue of fitting four round RPRs into the four square outlines of FIG. 2.

Figure 2C:
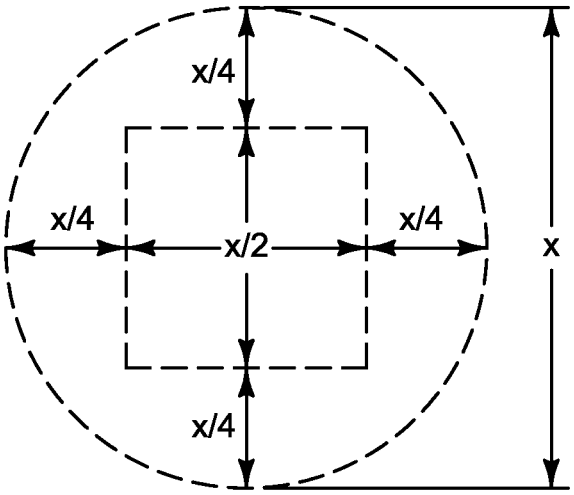

FIG. 2C shows an embodiment of a circular RPR with four sides clipped to form a square. The round RPR has a diameter of X. The square inside the outline of the round RPR has a side of X/2. Four edges are trimmed off of the round RPR resulting in a square of side X/2 and area of $(X/2)^2$ or $X^2/4$. The area lost due to trimming a circle of radius X/2 into a square of side X/2 is $\pi$ $(X^2/4)$ minus $(X/2)^2$ or $X^2/4$ $(\pi-1)$ or about 68%. The CRPR of FIG. 2C enables four CRPRs to fit within a square of side X as shown in FIG. 2B. Thus by clipping four RPRs to fit into a square of side X, results in an total area increase of $X^2$ over that of a single circle of area $\pi(X/2)^2$ or 27% This also enables four light emitters instead of one, increasing the total light output. Further, as discussed in conjunction with FIG. 1, the light emitted by a RPR typically decreases with increasing distance from the center of the RPR. Therefore, even though 68% of the circular area is lost in the clipping process, less than 68% of the light emission is lost. The combination of increased total area of the RPRs, increased numbers of light emitters and emission loss less than the area loss due to clipping results in an increase in light emission typically in excess of two times.

Figure 2D:
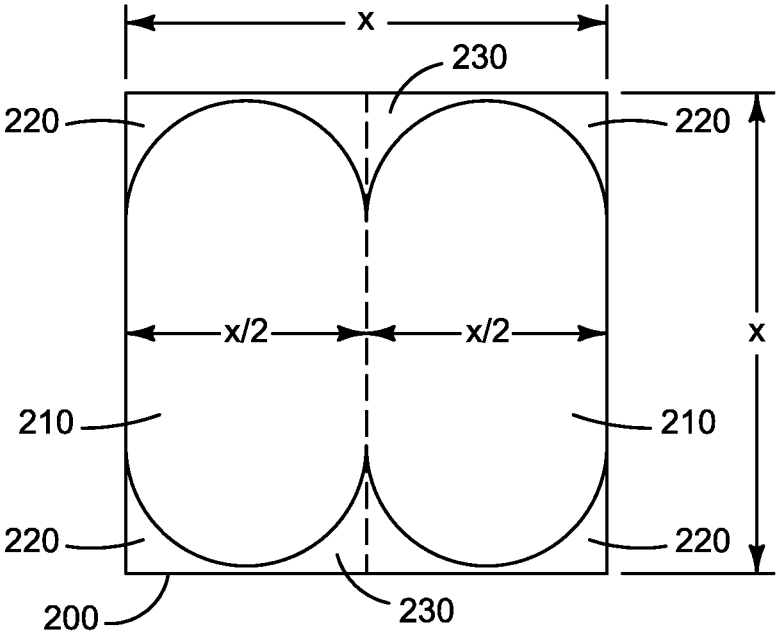

FIG. 2D shows another embodiment of a clipped RPR 210 hereinafter referred by the initials CRPR. Again, the advantage of CRPR in FIG. 2D allows two CRPRs to be placed in a square faceplate 200 of side X. Without clipping, only one RPR of diameter X fits into a square of side X. By clipping two opposite edges by X/4, two CRPRs can be fit into a square of side X. This results in an area increase of 21% over the area of a single round RPR and over 95% of the area of the square of side X. Additionally two light emitters, not shown, one for each CRPR, are possible. Further, since the clipped areas are toward the outer edges of the RPRs, the higher light emission areas near the center of the RPR are left intact. In FIG. 2D there are six open areas without a RPR surface, four indicated as 220 and two indicated as 230. These open areas 220 and 230 are available for other emitters as will be discussed below.

Figure 3:
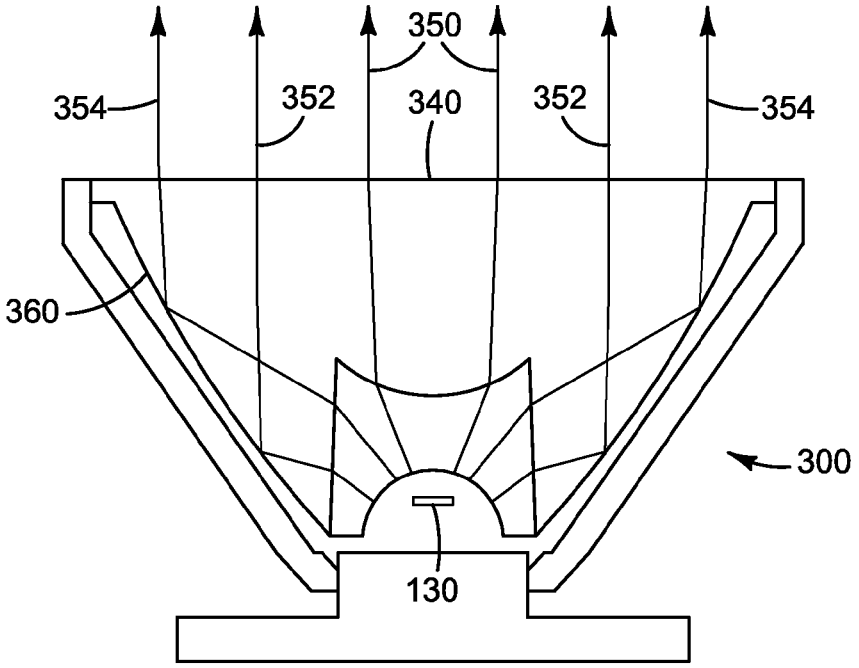
FIG. 3 shows an embodiment of a totally internal reflection or TIR optic.

FIG. 3 shows an embodiment of a totally internal reflector 300 hereafter referred to as a TIR 300. The TIR type optic does not rely on mirrored or silvered surfaces but rather reflections of the light internal to the material The light emitter 130 emits several light beams indicated by rays 350, 352 and 354. Rays 350 shine from the center portion through the front surface 340 of the TIR, while rays 352 and 354 first internally reflect in the TIR material 360. While rays 350, 352 and 354 are shown parallel to each other, still other embodiments of the TIR can direct rays at angle other than perpendicular to the TIR front surface 340. Such divergent rays give a wider, flood type illumination.

Figure 4:
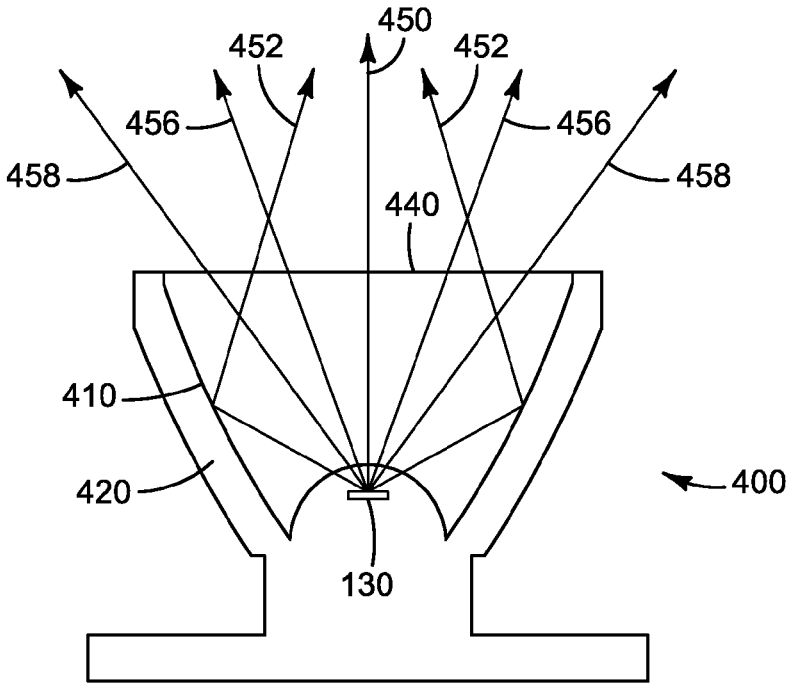
FIG. 4 shows an embodiment of a molded reflector lens.

FIG. 4 shows an embodiment of a reflector lens 400. The body 420 of the reflector lens 400 holds a reflective surface 410 in various places. A light emitter 130 emits a number of light beams indicated by rays 450, 452, 456 and 458. These rays exit the front surface 440 of the reflector lens 400 either directly or by first bouncing off of the reflective surface 410. The shape of the body 420 determines at what angles the rays 450, 452, 456, 458 exit the front surface 440. Thus the reflector lens 400 can emit a spot light type beam or a flood light type beam. While the rays 450, 452, 456, 458 are shown as direct or reflected, other embodiments may additionally use total internal reflection, also called TIR. Consequently, an infinite number of combinations of reflective surface, TIR, angle and direct emission are possible. In other embodiments a number of lens bodies 420 may be molded together to form a lens array with selectively applied reflective areas 410.

Figure 5A:
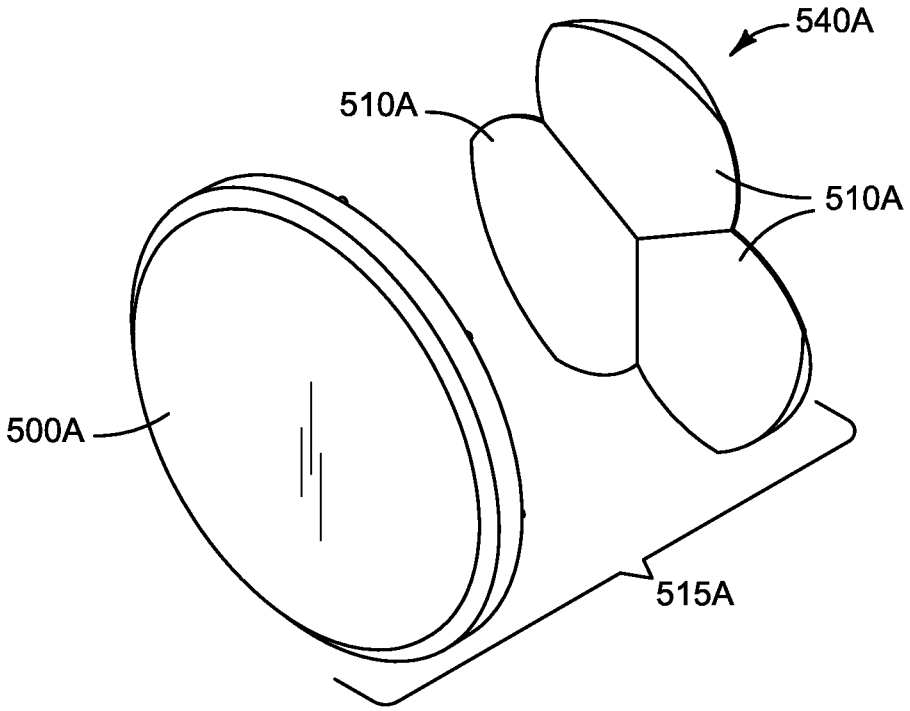
FIGS. 5AE-5DE show exploded views of various embodiments of a planar frame or faceplate having a combination of molded lenses and CRPRs.
Figure 5A:
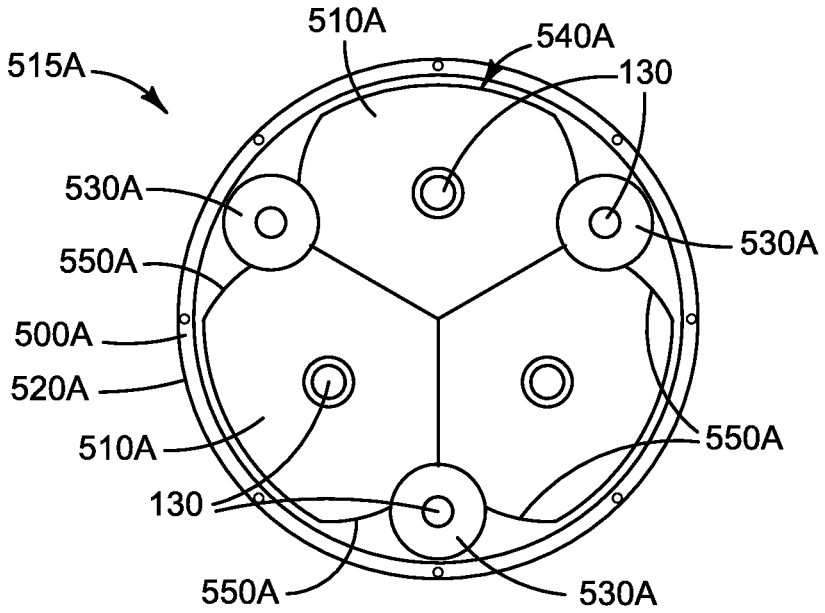
Figure 5B:
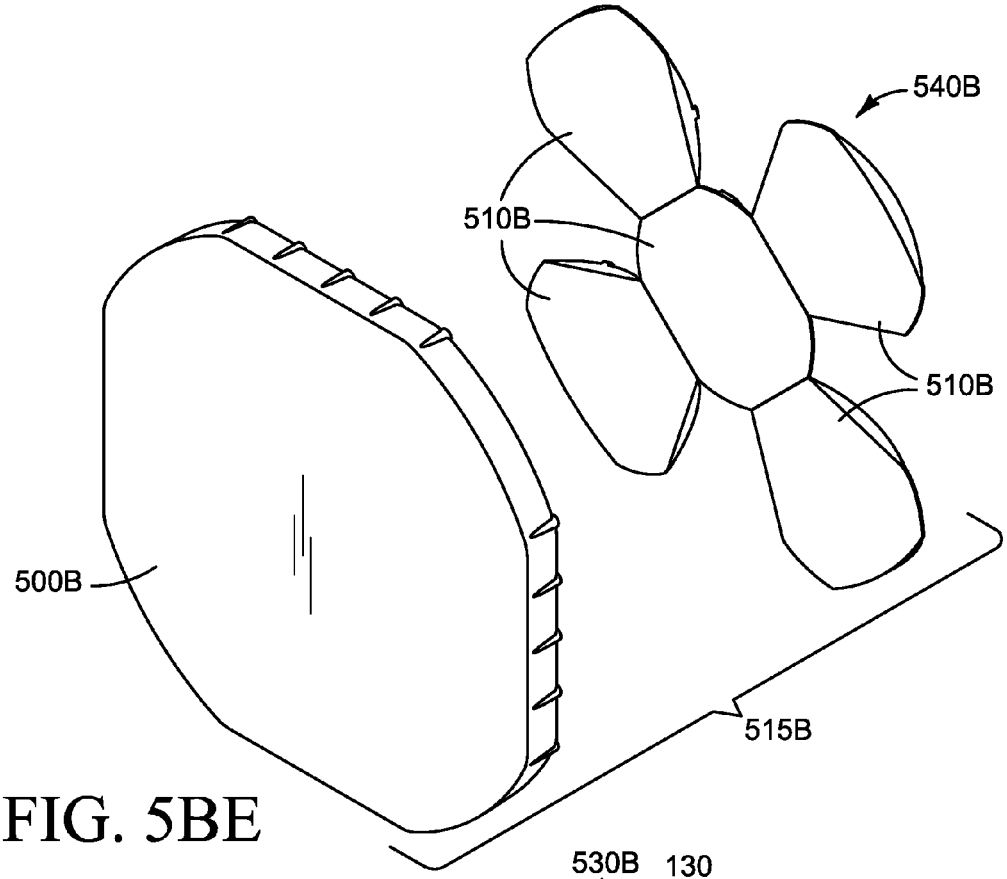
Figure 5B:
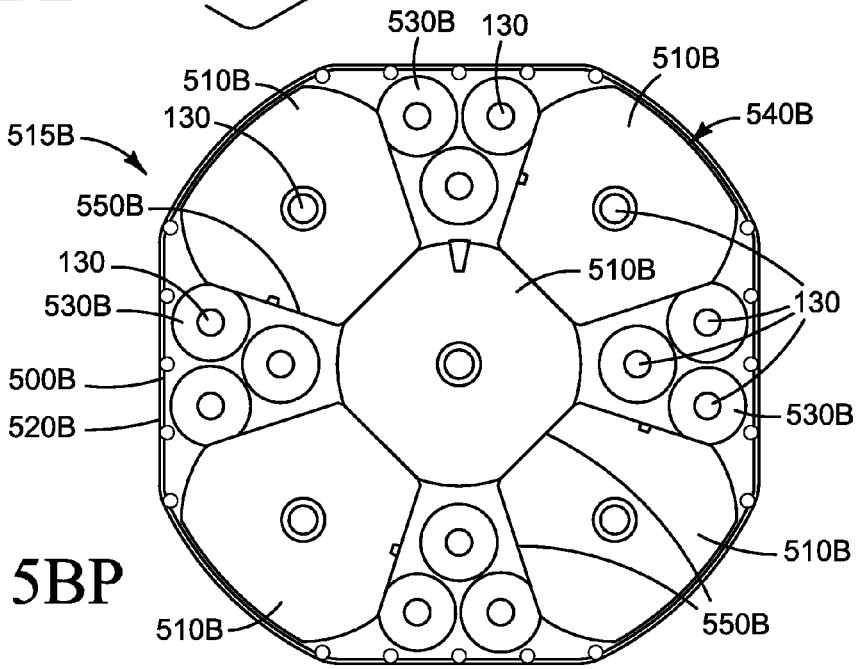
Figure 5C:
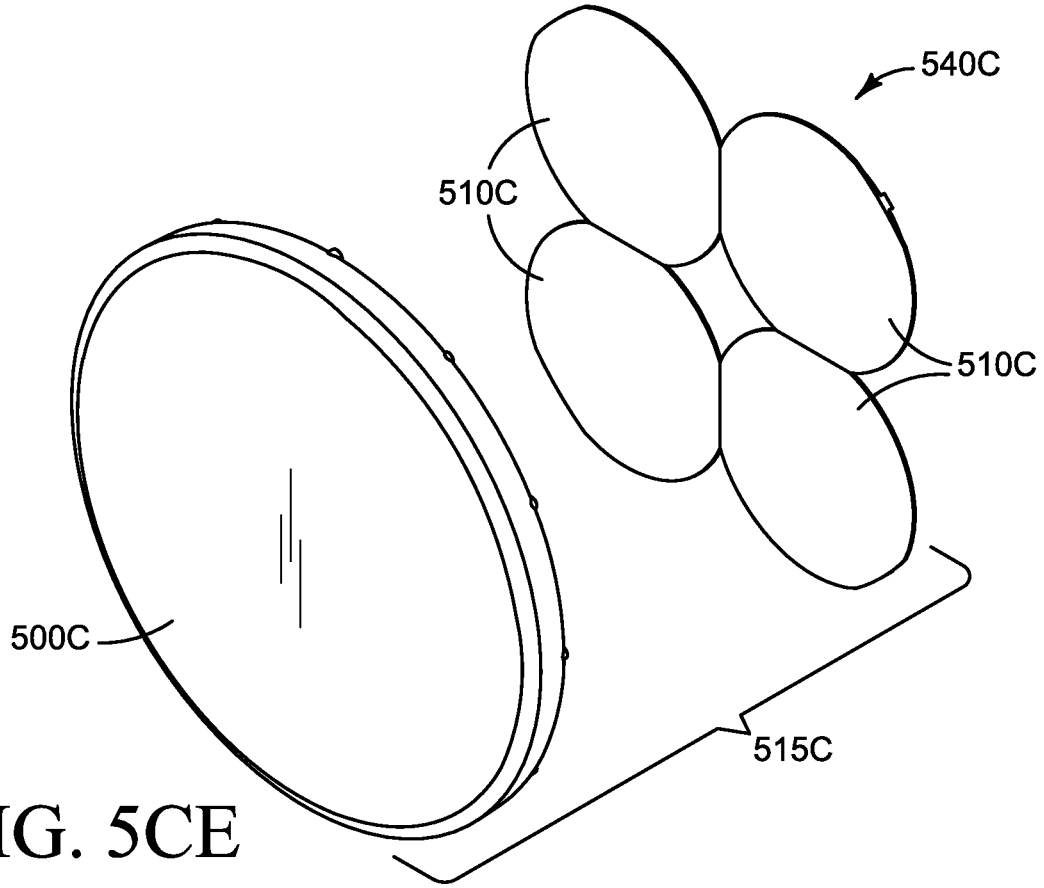
Figure 5C:
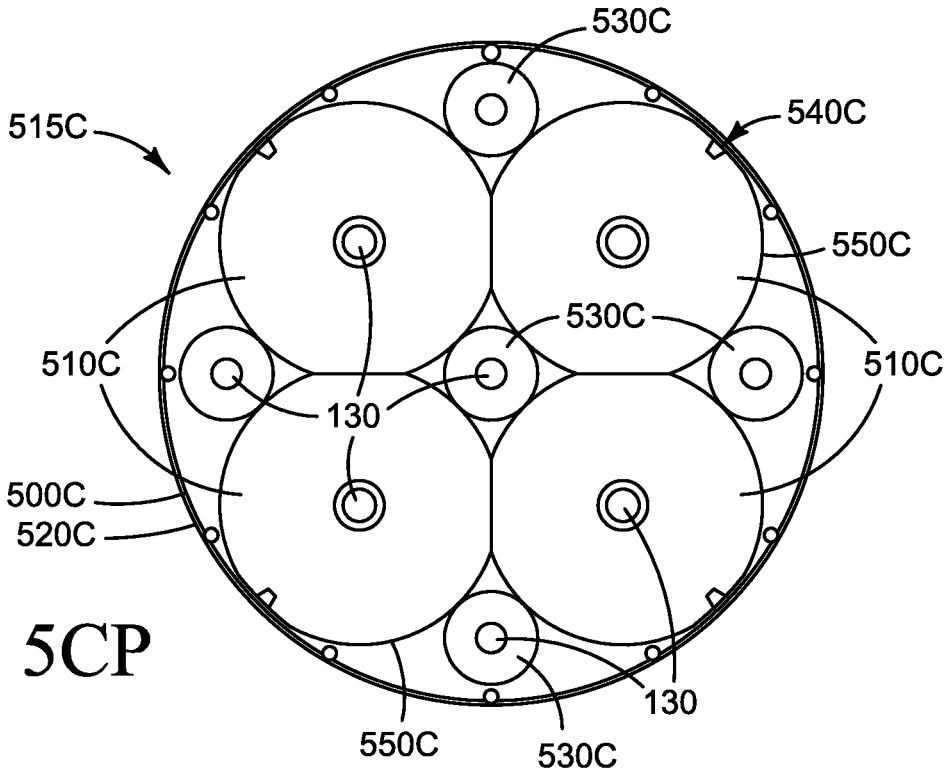
Figure 5D:
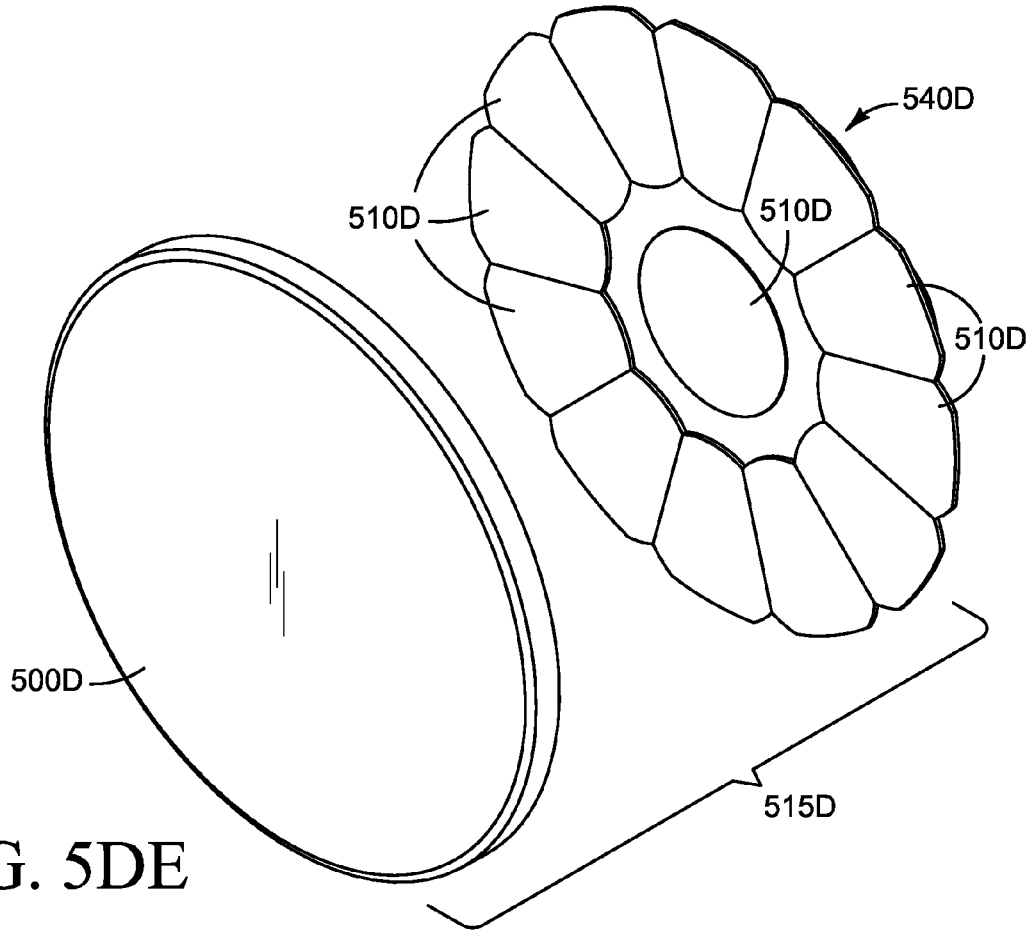
Figure 5D:
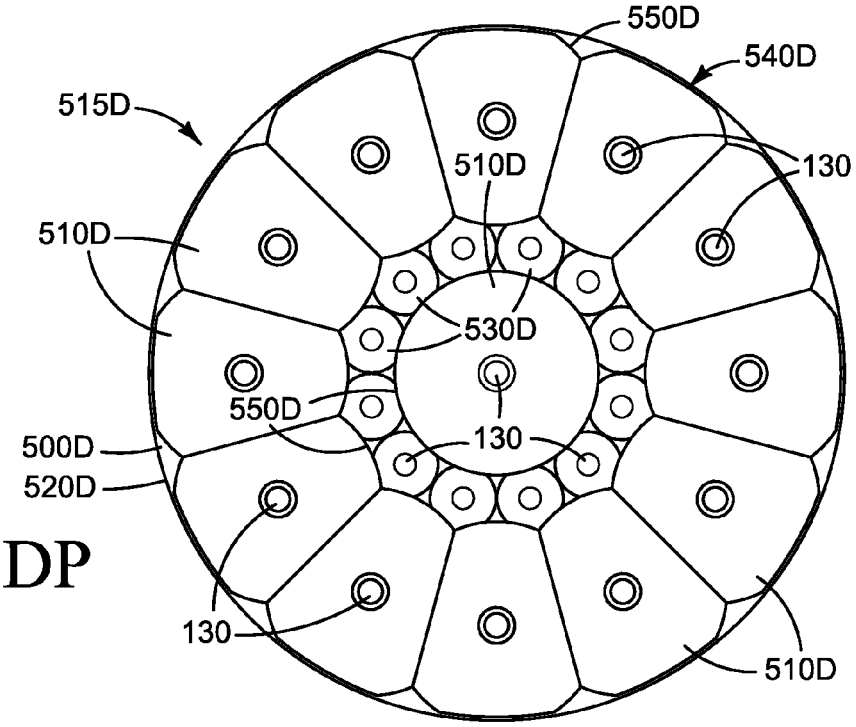

FIGS. 5AE-5DE show exploded views of embodiments of faceplates 500A, 500B, 500C, 500D with CRPR clusters 540A-540D made with CRPRs 510A-510D. FIG. 510D shows an embodiment with a cluster 540D that has a combination of CRPRs 510D and one non-clipped RPR 510D. FIGS. 5AP-5DP show plan views of assemblies 515A-515D of faceplates 500A-500D with CRPRs 510A-510D and lenses 530A-530D. Each faceplate 500A, 500B, 500C, 500D has a shape defined by an outline or perimeter 520A, 520B, 520C, 520D. The faceplates 500A, 500B, 500C, 500D are molded from a transparent material such as acrylic, glass or polycarbonate, although other materials are possible. Also molded into the faceplate are one or more molded lenses 530A, 530B, 530C, 530D. These molded lenses 530A, 530B, 530C, 530D can be of the TIR type shown in FIG. 3, the reflector type shown in FIG. 4, a hybrid type lens or a combination of lens types. In the case of reflector type lenses, a reflective coating is applied to selected areas of the faceplate to form the molded lenses 530A, 530B, 530C, 530D. The phrase molded lenses in this disclosure refers to either a TIR lens or a reflector type lens or a hybrid lens that combines the two types.

One or more CRPRs and/or RPRs 510A, 510B, 510C, 510D fit together to form a cluster of clipped RPRs 540A, 540B, 540C, 540D. Some embodiments have the RPRs of a cluster angled relative to each other to form a desired light emission pattern. The cluster 540A, 540B, 540C, 540D fit into the faceplate 500A, 500B, 500C, 500D. The faceplate 500A, 500B, 500C, 500D defines one or more locations 550A, 550B, 550C, 550D that act to orient the CRPRs or clusters. In some embodiments, these defined locations orient an individual CRPR while in other embodiments a defined location can orient a cluster. Depending upon the embodiment, the defined locations 550A, 550B, 550C, 550D can take the form of recesses, ridges, pegs or other features in the faceplate 500A, 500B, 500C, 500D to constraint the position, angle and orientation of the RPRs, CRPRs, or clusters. One or more light emitters 130 fit into each RPR, CRPR 510A-510D and molded lens 530A-530D.

Figure 6A:
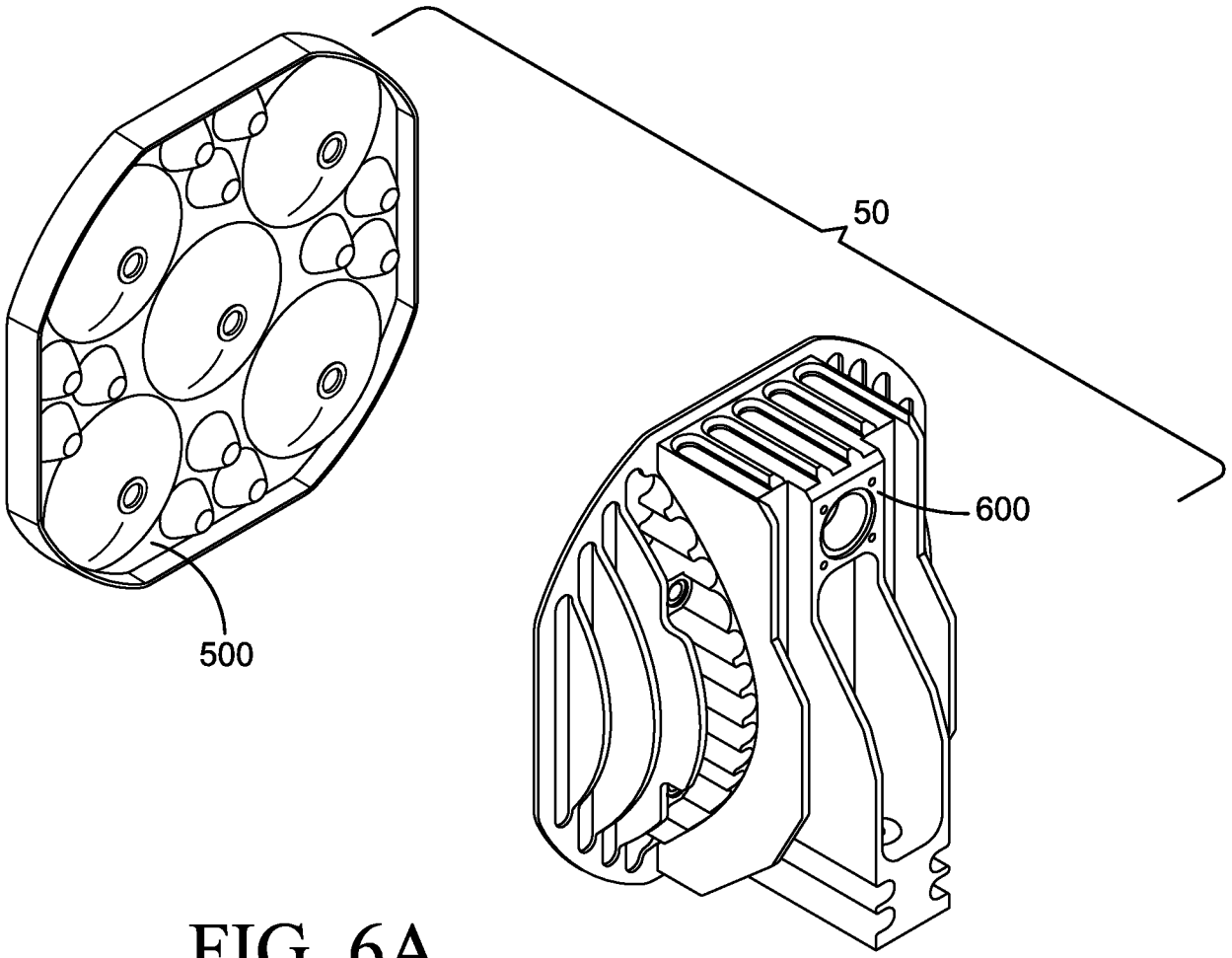
FIGS. 6A and 6B show embodiments of faceplates or planar frames sealed to a lamp housing.
Figure 6B:
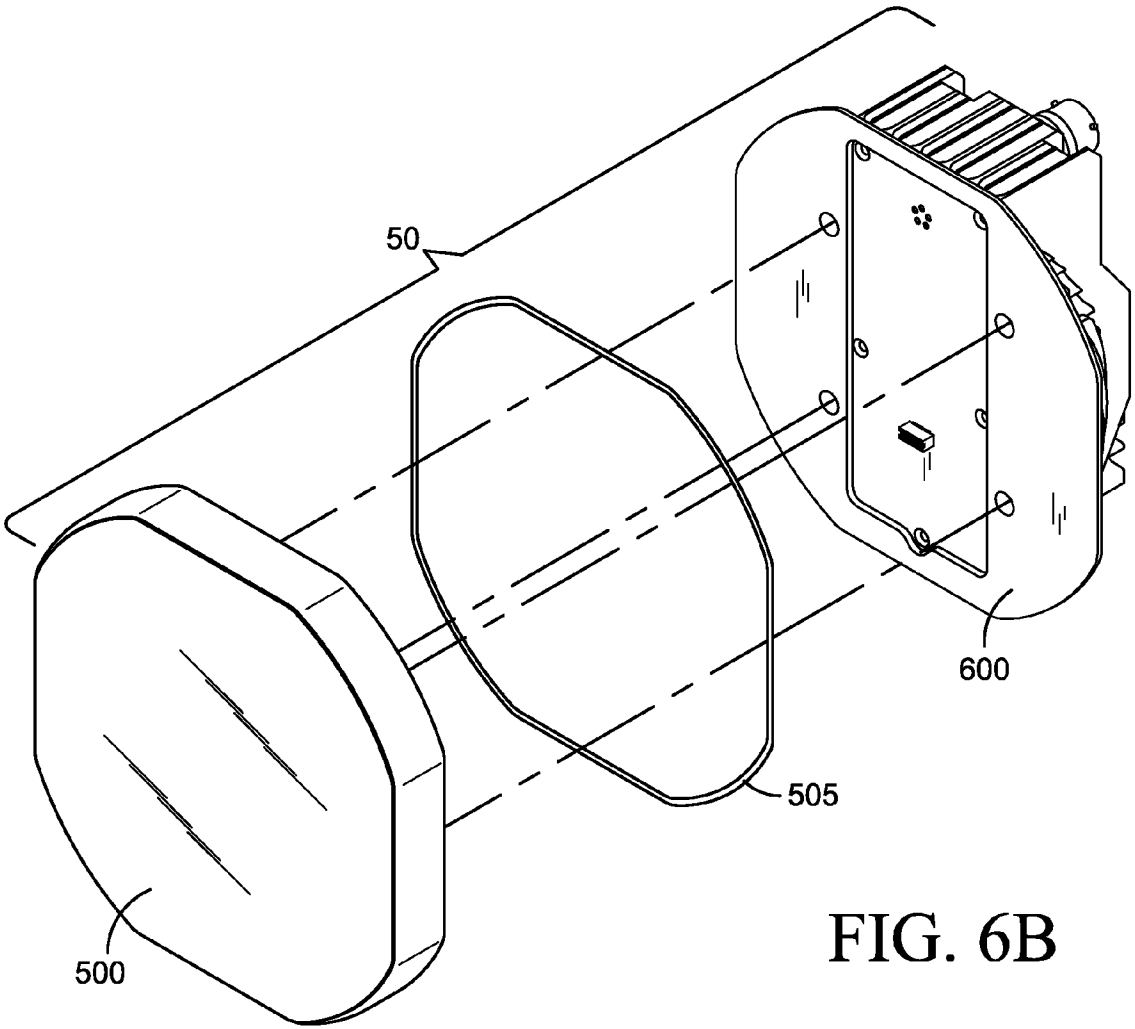

FIGS. 6A and 6B show embodiments of a faceplate 500 or planar faceplate 500 sealed to a lamp housing 600 to form a lighting fixture 50. The faceplate 500, depending upon embodiment, can be one of the faceplate embodiments of FIGS. 5AP, 5BP, 5CP, 5DP as well as other faceplate embodiments. The faceplate 500 performs several functions simultaneously. It provides a transparent or light transmissive surface to emit light from the reflectors and lenses, it holds the molded lenses, it orients and constrains the RPRs, CRPRs, and clusters, it seals against the lamp housing 600. In some embodiments the sealing is accomplished by the use of adhesives while in other embodiments the sealing is accomplished with gaskets or seals 505.

Figure 7A:
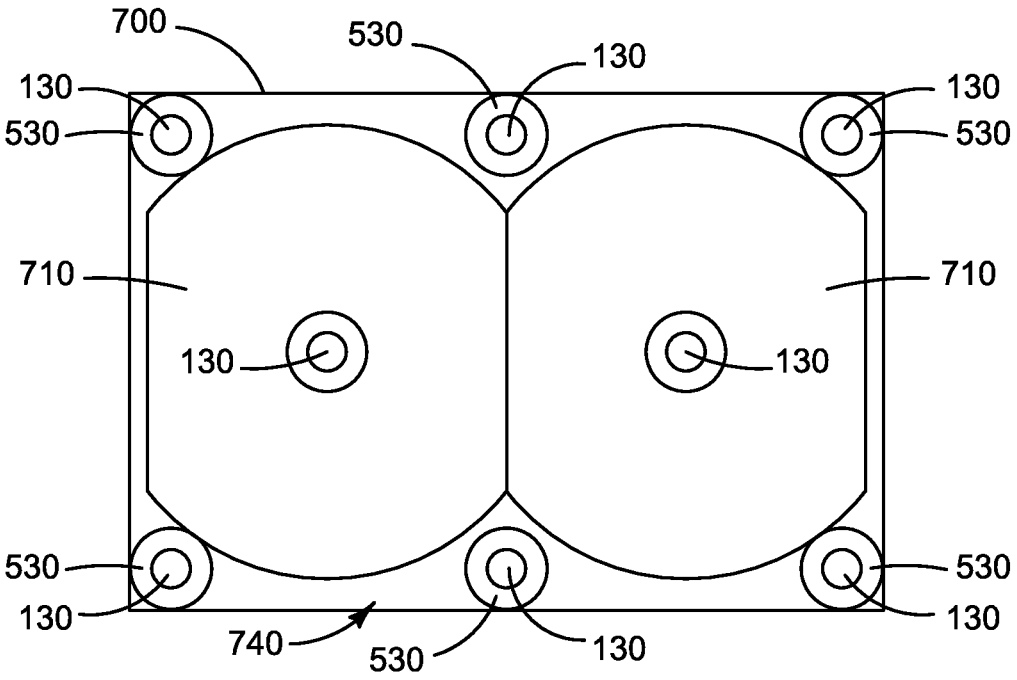
FIGS. 7A and 7B show an embodiment of a planar frame or faceplate with LEDs as light emitters.
Figure 7B:
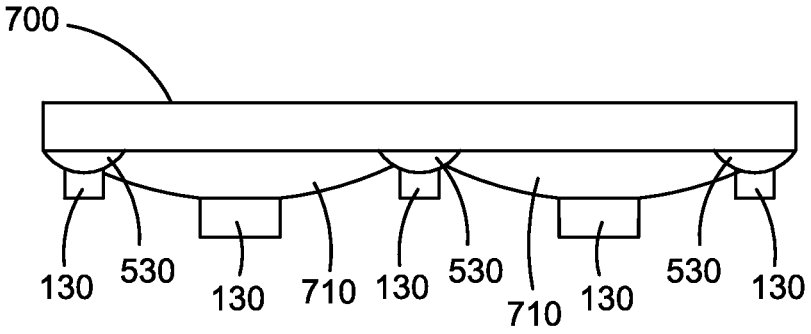

FIG. 7A shows a frontal view of an embodiment of a rectangular faceplate 700 with a cluster 740 of two clipped RPRs 710, six molded lenses 530 and eight light emitters 130. This view is followed by a profile view FIG. 7B of the same faceplate 700. A light emitter 130 is centered in each of the clipped RPRs 710 and molded lenses 530. Other embodiments use a mix of clipped and non-clipped RPRs to form the cluster 740. The molded lenses can be of the TIR type, reflector type, a hybrid or mix of the two types.

Figure 8:
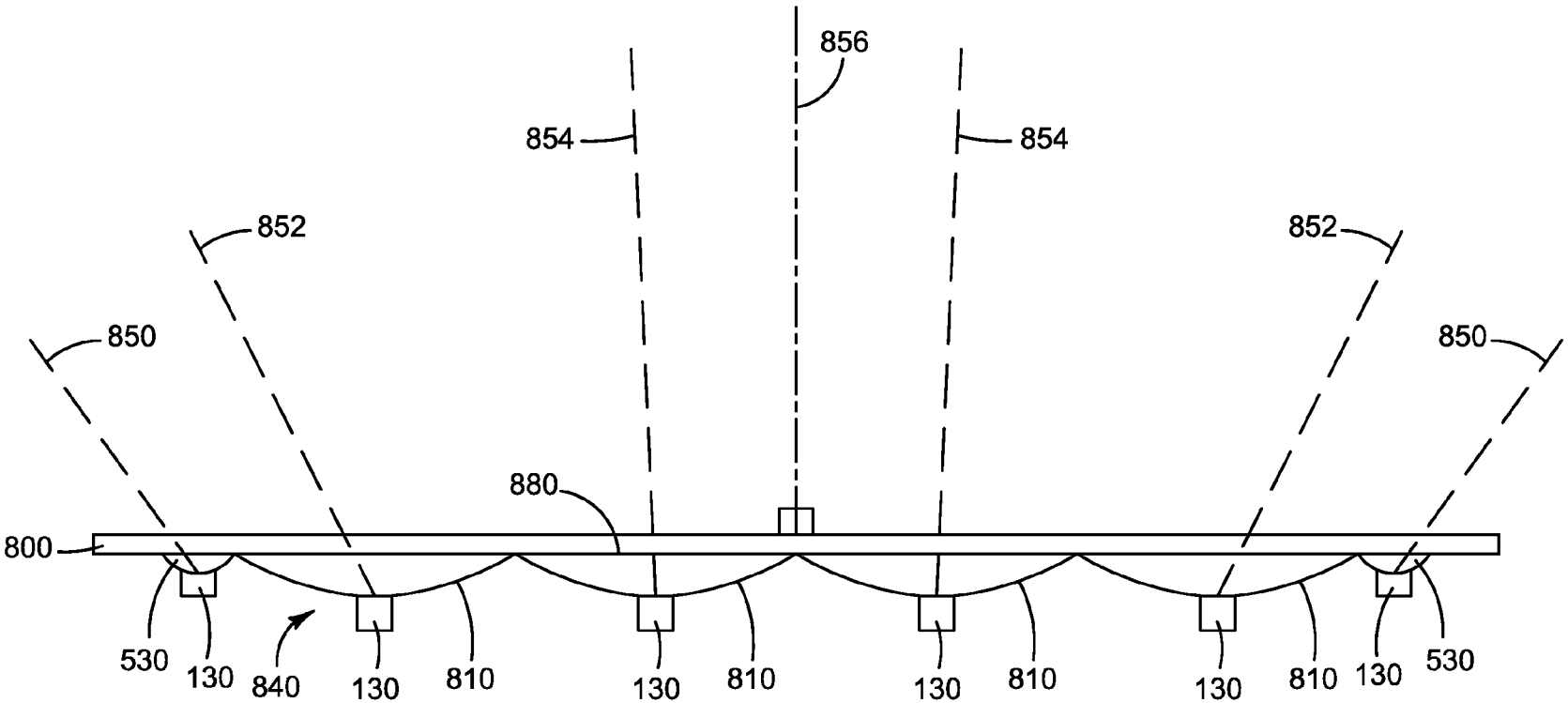
FIG. 8 shows a side profile view of an embodiment of the light fixture with a selected emission pattern.

FIG. 8 shows profile view of an embodiment of a faceplate 800 with a cluster 840 of CRPRs 810 of which four are indicated. Two molded lenses 530 and six light emitters 130 are indicated. One or more light emitters 130 are centered in each of the CRPRs 810 and molded lenses 530. Other embodiments use a mix of clipped and non-clipped RPRs either individually or in cluster like the cluster of 840. The molded lenses 530 can be of the TIR type, reflector type, a hybrid or mix of the two types. FIG. 8 further shows how the molded lenses can be molded into the faceplate at an angle so as to direct the light output at an angle from the perpendicular to the front surface of the faceplate. The dashed lines 850, 852, 854 depict light rays exiting an angle relative to the perpendicular 856 to the faceplate surface 880. While the faceplate surface 880 is shown as flat or planar in FIG. 8, other embodiments employ a curved faceplate surface.

Figure 9:
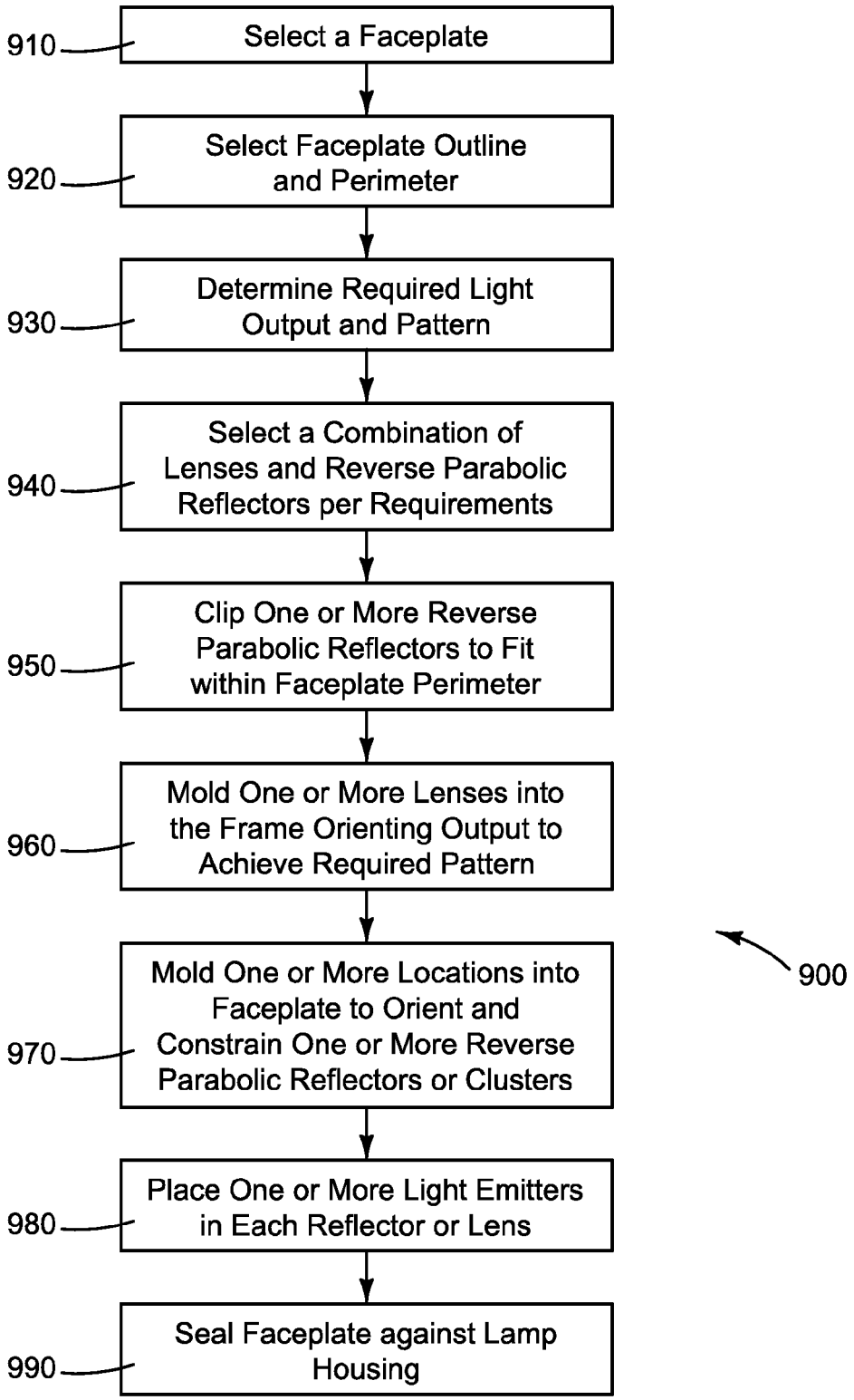
FIG. 9 shows a flowchart of one embodiment of a method for constructing a lighting fixture.

FIG. 9 is a flowchart 900 for one embodiment of a method for building a lighting fixture. The method begins with the selection of a faceplate or frame surface at 910. The faceplate, also called a frame, can have a planar surface or a curved surface depending upon the allowable space and other requirements such as light output and light pattern. The outline or perimeter shape of the faceplate or fame is also selected at 920. As seen in FIGS. 2, 5A, 5B, 5C, 5D, 6 and 7, the shape of the faceplate can be any shape and is determined by the application. Block 930 is where the application specifies the light output and pattern referred to as the requirements. In some cases for example, a spot light type beam is required, while other applications require a flood light. Still other applications may require a main spotlight with a smaller amount of light off-center from the main spotlight. The number and type of reflectors and lenses are chosen to provide the required light output and pattern at 940. This can include specifying the number, the type and the angle and orientation of reflectors and lenses to meet the requirements of light output and pattern. Also at 940, the type and number of light emitters are chosen. At 950 one or more of the RPRs is clipped to fit within the faceplate perimeter. As disclosed, clipping the edges of a RPR does not reduce the light output significantly, thus more RPRs and light emitters can fit into a given faceplate perimeter with a consequent increase in light output. At

960 the areas not occupied by RPRs can have molded lenses of the TIR or reflector type. These molded lenses can be angled relative to the surface of the faceplate to establish the required light emission pattern. During the molding of the faceplate, at 970 one or more locations are molded into the faceplate to orient and constrain the RPRs, clipped RPRs or cluster of RPRs. These molded locations help aim the light output of the RPRs and aid in assembly. At 980 one or more light emitters are placed in the center of each parabolic reflectors and lens. At 990 the faceplate, together with reflectors, lenses and emitters is sealed to a provided lamp housing. This sealing can be accomplished with adhesives, gaskets or other types of sealing methods.

Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

| Ref. | Name and/or Description | Figs. |
|---|---|---|
| 50 | Lighting fixture | 6A, 6B |
| 100 | RPRs. Referred to by initials RPR. | 1A, 1B |
| 110 | Parabolic reflector surface: The parabolically shaped reflective surface of the RPR. | 1A |
| 120 | Front mirrored reflective surface: The front reflective surface of the RPR | 1A |
| 130 | Light emitter: Light source such as an LED, halogen or incandescent lamp, etc | 1A |
| 140 | Front surface of RPR | 1A |
| 150 | Light rays exiting RPR | 1A |
| 152 | Light rays: Exiting RPR after front mirrored surface and parabolic reflection | 1A |
| 154 | Light rays: Exiting RPR after a surface reflection and reflection off of parabolic reflector | 1A |
| 156 | Light rays: Exiting RPR after a single parabolic reflection. | 1A |
| 200 | Square Faceplate | 2D |
| 210 | Clipped RPRs: RPRs with one or more trimmed edges. | 2D |
| 220, 230 | Open area without RPR. | 2D |
| 300 | TIR: Totally internal reflection type lens. | 3 |
| 340 | Front surface of TIR | 3 |
| 350 | Ray: Exiting TIR perpendicular to front surface of TIR lens. | 3 |
| 352 | Ray from TIR | 3 |
| 354 | Ray from TIR | 3 |
| 360 | Material of TIR | 3 |
| 400 | Reflector lens: A type of lens relying at least partially on a reflective surface | 4 |
| 410 | Reflector lens reflective surface: Reflective material applied to molded body of lens | 4 |
| 420 | Reflector lens body: such as a molded polycarbonate or acrylic | 4 |
| 440 | Front surface of reflector lens | 4 |
| 450 | Ray: Exiting reflector lens perpendicular to front surface of reflector lens. | 4 |
| 452 | Ray: Exiting reflector lens at angle relative to the perpendicular to front surface of reflector lens. | 4 |
| 456 | Ray: Exiting reflector lens at angle relative to the perpendicular to front surface of reflector lens | 4 |

-continued

| Ref. | Name and/or Description | Figs. |
|---|---|---|
| 458 | Ray: Exiting reflector lens at angle relative to the perpendicular to front surface of reflector lens | 4 |
| 500, 500A, 500B, 500C, 500D | Faceplate, also called a planar frame in some embodiments. | 5A, 5B, 5C, 5D, 6A, 6B |
| 505 | Seal or gasket between faceplate and lamp housing | 6B |
| 510A, 510B, 510C, 510D, | Clipped reverse parabolic reflector(s) or CRPR(s). | 5A, 5B, 5C, 5D |
| 515A, 515B, 515C, 515D | Assemble of faceplate with molded lenses, and various combinations of RPR(s), CRPR(s) and cluster(s). | 5A, 5B, 5C, 5D |
| 520A, 520B, 520C, 520D | Perimeter also called an outline of faceplate or planar frame | 5A, 5B, 5C, 5D |
| 530, 530A, 530B, 530C, 530D | Molded lens. The lenses, either TIR, reflector, hybrid or other, molded into the faceplate | 5A, 5B, 5C, 5D |
| 540A, 540B, 540C, 540D, | Clipped or non-clipped RPRs fitted together to form a cluster. Clusters can also have RPRs angled relative to each other. | 5A, 5B, 5C, 5D |
| 550A, 550B, 550C, 550D | Defined location or area in faceplate for RPRs, clipped RPRs or clusters. | 5A, 5B, 5C, 5D |
| 600 | Lamp housing | 6A, 6B |
| 700 | Faceplate | 7A, 7B |
| 710 | Clipped RPR also referred to as CRPR | 7A, 7B |
| 740 | Cluster of CRPRs | 7A |
| 800 | Faceplate | 8 |
| 810 | Clipped or non-clipped RPRs | 8 |
| 840 | RPRs fitted together to form a cluster | 8 |
| 850, 852, 854 | Rays exiting faceplate at an angle | 8 |
| 856 | Ray exiting perpendicular to faceplate surface | 8 |
| 880 | Faceplate surface | 8 |
| 900 | Method flowchart. | 9 |
| 910 | Selecting a faceplate: Choosing a shape of the faceplate. | 9 |
| 920 | Selecting a perimeter or closed perimeter. Some embodiments include an edge to which the lamp housing will seal. | 9 |
| 930 | Determining the required light output and pattern. The requirements. | 9 |
| 940 | Selecting a combination of RPRs, CRPRs, clusters and lenses per the requirements | 9 |
| 950 | Selectively clipping RPRs, allowing more RPRs to fit within perimeter or allowing room for lenses. | 9 |
| 960 | Molding one or more lenses into the planar frame. Molded lenses can be of reflector or TIR type that are molded as part of the faceplate | 9 |
| 970 | Mold one or more locations into the frame to constrain the orientation of RPRs, CRPRs or clusters. | 9 |
| 980 | Placing one or more light emitters in each reflector or lens. | 9 |
| 990 | Seal faceplate or perimeter to lamp housing forming a seal | 9 |

We claim:

1. A lighting fixture comprising:

a light transmissive faceplate having a perimeter;

at least one molded lens molded into the faceplate;

at least one clipped reverse parabolic reflector, each clipped reverse parabolic reflector having a defined area;

the faceplate further defining at least one location for the at least one clipped reverse parabolic reflector; and a light emitter, centered in each lens and in each clipped reverse parabolic reflector.

2. The lighting fixture of claim 1 wherein at least one molded lens is a totally internal reflection lens.

3. The lighting fixture of claim 1 wherein at least one molded lens is a reflector lens.

4. The lighting fixture of claim 1 wherein a plurality of clipped reverse parabolic reflectors are clipped to increase the number of reverse parabolic reflectors within the faceplate perimeter thus increasing the summation of the defined areas of the clipped reverse parabolic reflectors within the perimeter.

5. The lighting fixture of claim 1 further including a lamp housing, the faceplate further adapted to seal against the lamp housing.

6. The lighting fixture of claim 1 wherein the faceplate is a single piece of lens grade polycarbonate.

7. The lighting fixture of claim 1 wherein the at least one location for the at least one clipped reverse parabolic reflector, constrains the orientation and angle of the clipped reverse parabolic reflector.

8. The lighting fixture of claim 1 wherein the light emitter emits light in a substantially lambertian pattern.

9. The lighting fixture of claim 1 wherein the light emitter is a light emitting diode.

10. The lighting fixture of claim 4 wherein a plurality of clipped reverse parabolic reflectors are fixed together to form a cluster.

11. A lighting fixture comprising:

a faceplate, the faceplate having a closed perimeter and a planar face;

a plurality of molded lenses molded into the faceplate within the perimeter of the faceplate;

a plurality of clipped reverse parabolic reflectors, each of the clipped reverse parabolic reflectors having a defined planar area, the clipped parabolic reflectors further adapted to emit light along an axis perpendicular to the defined planar area;

the faceplate further defining a plurality of locations for the plurality of clipped reverse parabolic reflectors; and a plurality of light emitters, at least one light emitter centered in each lens and in each clipped reverse parabolic reflector.

12. The lighting fixture of claim 11 wherein at least one of the defined plurality of locations for the plurality of clipped reverse parabolic reflectors, aims light emitted from the clipped reverse parabolic reflectors at an angle other than perpendicular to the planar face of the faceplate.

13. The lighting fixture of claim 11 wherein at least one of the molded lenses is adapted to emit light at an angle other than perpendicular to the planar face of the faceplate.

14. The lighting fixture of claim 11 wherein at least one of the plurality of molded lenses is a totally internal reflection lens.

15. The lighting fixture of claim 11 wherein at least one of the plurality of molded lenses is a reflector lens.

16. A method of building a lighting fixture, the method comprising:

selecting a faceplate, the faceplate having a perimeter;

determining light output and pattern requirements of lighting fixture;

selecting a combination of reverse parabolic reflectors and lenses to meet light output and light pattern requirements;

molding a plurality of lenses into the faceplate;

selectively clipping the edges on at least one reverse parabolic reflector to form at least one clipped reverse parabolic reflector;

molding a location in the faceplate for at least one clipped parabolic reflector, the location adapted to constrain the clipped parabolic reflector; and placing an LED in the center of each clipped parabolic reflectors and each of the plurality of lenses.

17. The method of building a lighting fixture, according to claim 16 further comprising providing a lamp housing; and sealing the perimeter of the faceplate to the lamp housing.

18. The method of building a lighting fixture, according to claim 16 further comprising adding a reflective coating to portions of the plurality of lenses.

19. The method of building a lighting fixture, according to claim 16 further comprising fixing together a plurality of clipped reverse parabolic reflectors to form a cluster.

* * * * *